US007021026B2

(12) United States Patent
Griggs et al.

(10) Patent No.: US 7,021,026 B2
(45) Date of Patent: Apr. 4, 2006

(54) NETTING CHUTES FOR MANUAL AND/OR AUTOMATED CLIPPING PACKAGING APPARATUS

(75) Inventors: Samuel D. Griggs, Raleigh, NC (US); Dennis J. May, Pittsboro, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/738,547

(22) Filed: Dec. 17, 2003

(65) Prior Publication Data

US 2005/0072119 A1 Apr. 7, 2005

Related U.S. Application Data

(63) Continuation of application No. 10/782,552, filed on Feb. 19, 2004, and a continuation-in-part of application No. 10/339,910, filed on Jan. 10, 2003, now Pat. No. 6,729,102.

(60) Provisional application No. 60/508,609, filed on Oct. 3, 2003, provisional application No. 60/347,477, filed on Jan. 11, 2002.

(51) Int. Cl.
*B65B 9/15* (2006.01)

(52) U.S. Cl. ..... 53/417; 53/459; 53/138.4; 53/201; 53/576; 53/551

(58) Field of Classification Search ..... 53/530, 53/577, 567, 576, 439, 459; D07/700; 126/283; 141/331, 336, 391

See application file for complete search history.

(56) References Cited

U.S. PATENT DOCUMENTS 2,720,055 A * 10/1955 Morris ..... 47/84
3,054,236 A * 9/1962 Stroop ..... 53/554
3,342,017 A * 9/1967 Yerkey ..... 53/255
3,358,418 A * 12/1967 Manetta ..... 53/530
3,389,533 A 6/1968 Tipper et al.
3,499,259 A * 3/1970 Tipper et al. ..... 53/413
3,587,204 A 6/1971 George ..... 53/138.4
3,662,514 A * 5/1972 Goss ..... 53/567
3,719,022 A * 3/1973 Cherio et al. ..... 53/255
3,732,662 A 5/1973 Paxton ..... 53/415
3,797,199 A * 3/1974 Seifert ..... 53/255
3,815,323 A 6/1974 Longo ..... 53/530
3,945,171 A * 3/1976 Marietta et al. ..... 53/576
D243,158 S 1/1977 Bolwell ..... D15/145
4,091,595 A 5/1978 Peister et al. ..... 53/417
4,247,005 A 1/1981 Buxton ..... 53/138.4
4,430,772 A * 2/1984 Michel et al. ..... 452/32
4,505,003 A * 3/1985 Becker et al. ..... 53/576
4,537,006 A * 8/1985 Pieri ..... 53/134.1
4,590,748 A 5/1986 Harrison et al. ..... 53/576
4,651,498 A * 3/1987 Piereder ..... 53/122
4,683,700 A 8/1987 Evans et al. ..... 53/138.4
4,766,713 A 8/1988 Evans ..... 53/138.2
5,016,424 A * 5/1991 Stirling ..... 53/459

(Continued)

OTHER PUBLICATIONS

Product Brochure, 1 sheet, "Tipper Netter TN-3000 Automatic Netting-Packaging Machine," © 2002.

(Continued)

*Primary Examiner*—John Sipos
(74) *Attorney, Agent, or Firm*—Myers Bigel Sibley & Sajovec PA

(57) ABSTRACT

Netting chutes suitable for use with manual and automatic packaging operations to enclose product in netting packaging include a non-circular cross-sectional cavity shape.

45 Claims, 18 Drawing Sheets

U.S. PATENT DOCUMENTS

| | | | | |
|---|---|---|---|---|
| 5,042,234 | A | 8/1991 | Evans et al. | 53/523 |
| 5,044,144 | A | 9/1991 | Foote et al. | 29/803 |
| 5,107,666 | A * | 4/1992 | Rahtican | 141/391 |
| 5,161,347 | A | 11/1992 | May et al. | 53/138.2 |
| D340,467 | S * | 10/1993 | Pollak | D7/700 |
| 5,402,625 | A * | 4/1995 | Halstead | 53/570 |
| 5,421,142 | A * | 6/1995 | Cullen | 53/567 |
| 5,426,910 | A | 6/1995 | Cullen | 53/576 |
| 5,495,701 | A | 3/1996 | Poteat et al. | 53/138.2 |
| 5,586,424 | A | 12/1996 | Chen et al. | 53/138.2 |
| 5,715,656 | A * | 2/1998 | Pearce | 53/451 |
| 5,884,346 | A * | 3/1999 | Hengl | 4/484 |
| 6,052,972 | A * | 4/2000 | Rea et al. | 53/576 |
| 6,131,367 | A * | 10/2000 | Fukuda et al. | 53/201 |
| 6,694,711 | B1 * | 2/2004 | Cullen | 53/567 |
| 6,708,742 | B1 * | 3/2004 | Weathers et al. | 141/391 |
| 6,719,194 | B1 * | 4/2004 | Richards | 232/43.1 |
| 6,729,102 | B1 * | 5/2004 | Ailey et al. | 53/134.1 |
| 6,745,547 | B1 | 6/2004 | Bussey et al. | 53/576 |
| 2005/0034426 | A1 | 2/2005 | Griggs et al. | 53/417 |
| 2005/0039419 | A1 | 2/2005 | Griggs et al. | 53/417 |

OTHER PUBLICATIONS

Product Brochure, 4 sheets, "Net-All® Netting Is The answer To All Your Horticultural Applications," © 2001.

Product Brochure, 2 sheets, "Net-All Sleeved Plastic Netting System," © 2000.

Product Brochure, 6 sheets, "Tipper Net For Smoking, Hanging & Decoration, Net-All® Netting is The Answer," © 2000.

Product Brochure, 1 sheet, "Tipper Clipper®—signature Series SZ3214 Double Clipper for Netting," © 2002.

Product Brochure, 2 sheets, "Tipper Net Z3200 Double Clipper and Plant Netting System," © 2000.

Product Brochure, 1 sheet, "Tipper Tie-Net, Safely and quickly package plugs before shipping," 201 1999.

* cited by examiner

NETTING CHUTES FOR MANUAL AND/OR AUTOMATED CLIPPING PACKAGING APPARATUS

RELATED APPLICATIONS

This application claims the benefit of priority of U.S. Provisional Patent Application Ser. No. 60/508,609, filed Oct. 3, 2003, the contents of which are hereby incorporated by reference as if recited in full herein, and this application is a continuation-in-part of U.S. patent application Ser. No. 10/339,910, filed Jan. 10, 2003, now U.S. Pat. No. 6,729,102, directly and/or via continuation application Ser. No. 10/782,552, filed Feb. 19, 2004, each of which claims the benefit of priority to U.S. Provisional Patent Application Ser. No. 60/347,477, filed Jan. 11, 2002.

FIELD OF THE INVENTION

The present invention relates to apparatus that can enclose products in packaging materials, and may be particularly suitable for enclosing products in clippable netting material.

BACKGROUND OF THE INVENTION

Certain types of commodity and/or industrial items can be packaged by placing the desired product(s) in a covering material and then applying a closure clip or clips to end portions of the covering material to secure the product(s) therein. For non-flowable piece goods, the piece goods can be held individually in a respective clipped package, or as a group of goods in a single package. The covering material can be any suitable material, typically a casing and/or netting material.

Generally described, when packaging a piece good product in netting, the product is pushed through a netting chute. The product can include, by way of example, a non-flowable semi-solid and/or solid object such as a meat product including whole or half hams, turkeys, chickens, and the like. The netting chute holds a length of a netting sleeve over the exterior thereof. A first downstream end portion of the netting is typically closed using a first clip. As the product exits the netting chute, it is covered with the netting. The netting can be held relatively tight (typically stretched or in tension) over the product. The open end of the netting (upstream of the product) is then gathered and another clip can be applied to the gathered netting, typically using a double clipper apparatus. A clip attachment apparatus or "clippers" are well known to those of skill in the art and include those available from Tipper Tie, Inc., of Apex, N.C., under product numbers Z3214, Z3202, and Z3200. Examples of clip attachment apparatus and/or packaging apparatus are descried in U.S. Pat. Nos. 3,389,533; 3,499,259; 4,683,700; and 5,161,347, the contents of which are hereby incorporated by reference as if recited in full herein.

The double clipper concurrently applies two clips to the netting proximate the open (upstream) end of the package. One clip defines the leading end portion of the next package and the other defines the trailing or second end portion of the package then being closed. A cutting mechanism incorporated in the clipper apparatus can sever the two packages before the enclosed package is removed from the clipper apparatus. U.S. Pat. No. 4,766,713 describes a double clipper apparatus used to apply two clips to a casing covering. U.S. Pat. No. 5,495,701 proposes a clipper with a clip attachment mechanism configured to selectively fasten a single clip or two clips simultaneously.

SUMMARY OF EMBODIMENTS OF THE INVENTION

Embodiments of the present invention provide netting product chutes with non-circular cross-sectional cavities that can be used to automatically and/or manually package a product in a covering material to which clips may be applied thereto.

In certain embodiments, the product can be manipulated and packaged so that at least one clip is automatically applied to enclose the product in the covering material after it exits the product chute. Particular embodiments automatically introduce and/or push a discrete object or objects through the chute and into netting and then automatically clip the netting holding the enclosed product to thereby automatically package the product(s).

Some embodiments are directed to netting/product chutes having an outer wall defining an interior cavity extending therethrough, the outer wall including an exterior surface adapted to hold netting thereon, the chute having a cavity with a non-circular cross-section.

In particular embodiments, the netting/product chute may include a primary body and an entry segment attached thereto. The entry segment can have a flared portion with a first cross-sectional area that tapers into an adjacent downstream portion proximate the primary body to have a smaller second cross-sectional area thereat. The chute may include a generally planar floor.

In some embodiments, the non-circular shape can be a generally pentagonal cross-sectional shape. In other embodiments the cavity cross-sectional shape comprises an upper triangular portion. In yet other embodiments, the cavity cross-sectional shape is generally oval while in other embodiments the product chute has a cavity cross-sectional shape with a generally curvilinear upper portion that terminates into a generally planar lower floor portion.

Certain embodiments are directed to systems for enclosing a semi-solid or solid product (or products) in a covering material. The systems include: (a) an elongate product chute having a generally planar floor, and an outer wall defining opposing receiving and discharge end portions and an interior cavity extending therethrough, the cavity having a non-circular cross-sectional shape; and (b) a clipper mechanism disposed downstream of the product chute. The clipper mechanism is configured to apply at least one clip to a covering material that resides over and encloses a product discharged from the product chute.

Other embodiments are directed to methods of packaging an object or objects in netting. The methods include: (a) pushing at least one object through a product chute having a floor and a non-circular cross-sectional shape; (b) pulling netting material downstream of the product chute off of an exterior surface of the product chute to automatically enclose the object in the netting material as the object exits the product chute; and then (c) applying at least one clip to the netting material to secure the object in the netting material.

These and other objects and/or aspects of the present invention are explained in detail in the specification set forth below.

DESCRIPTION OF EMBODIMENTS OF THE INVENTION

Figure 1:
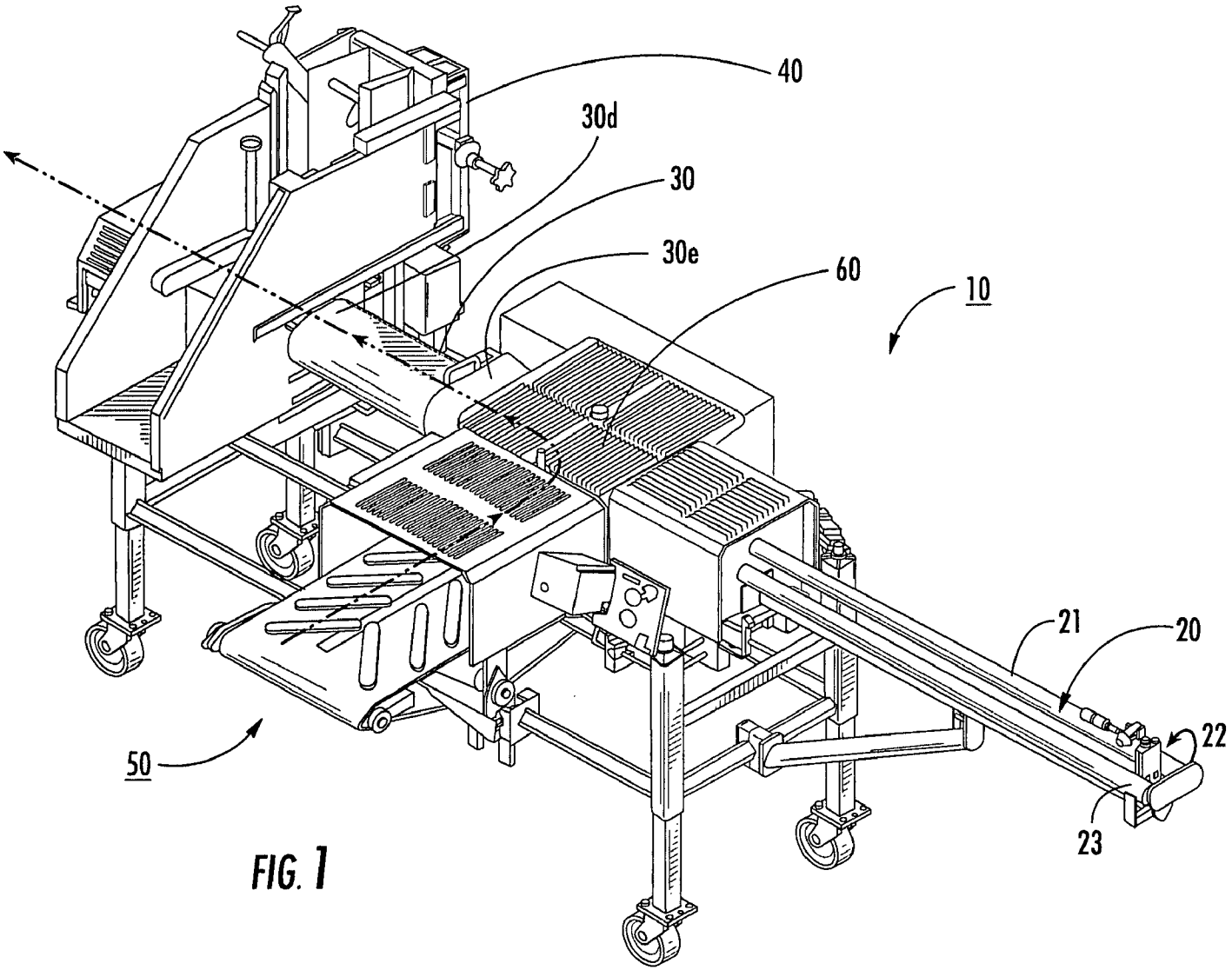
FIG. 1 is a front perspective view of an apparatus/system used to automatically advance objects through a product chute and then automatically apply a clip(s) via a clipper mechanism according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations, unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously. In addition, as used herein the term "and/or" includes any and all combinations of one or more of the associated listed items.

In the description of the present invention that follows, certain terms are employed to refer to the positional relationship of certain structures relative to other structures. As used herein, the term "front" or "forward" and derivatives thereof refer to the general or primary direction that the product travels for packaging and closure; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the directions opposite, respectively, the forward and downstream directions.

Embodiments of the present invention are particularly suitable for applying closure clips to discrete objects held in a covering material. The covering material may be natural or synthetic and may be a casing material that can be sealed about a product or may be netting. The casing can be any suitable casing (edible or inedible, natural or synthetic) such as, but not limited to, collagen, cellulose, plastic, elastomeric or polymeric casing. The term "netting" refers to any open mesh material in any form including, for example, knotted, braided, extruded, stamped, knitted, woven or otherwise. Typically, the netting is configured so as to be elastic and/or stretchable in both axial and lateral directions (isotropically elastic).

Netting or other covering material may be used to package discrete meat products such as loaves of meat, boned ham, spiral-sliced ham, deboned ham, turkey, turkey loaves held in molds, or other meat items; the packaging may be performed on the item or items alone or with the item or items held in subcontainers and/or wraps such as molds, trays, boxes, bags, absorbent or protective sheets, sealant, cans and the like. Other embodiments of the present invention may be directed to package other types of food such as cheese, bread, fruit, vegetables, and the like. Examples of non-food items that may be packaged using embodiments of the present invention include living items such as flora, trees, and the like, as well as inanimate objects. Additional examples of products include discrete, semi-solid or solid non-flowable objects such as firewood, pet food (typically held in a container if the wet type), recreational objects (such as balls), or other solid or semi-solid objects. The product may be a packaged for any suitable industry including horticulture, aquaculture, agriculture, or other food industry, environmental, chemical, explosive, or other application. Netting may be particularly useful to package ham or turkeys, manufactured hardware such as automotive parts, firewood, explosives, molded products, and other industrial, consumable, and/or commodity item(s).

Generally stated, embodiments of the present invention are directed to the packaging of piece goods or discrete items by forcing them through a product chute, wrapping or enveloping the objects at the other end of the chute in a covering material, such as netting, then clipping the covering material with a closure clip or other attachment means to close the covering and hold the object or objects inside of the covering material. As noted above, clippers are available from Tipper Tie, Inc., of Apex, N.C. Examples of suitable clips include metallic generally "U"-shaped clips available from Tipper Tie, Inc., in Apex, N.C. Other clips, clip materials, and clip configurations or closure means may also be used.

FIG. 1 illustrates an exemplary automatic clipping packaging apparatus 10 according to embodiments of the present invention. As shown, the apparatus 10 includes a product pusher assembly or mechanism 20, a product chute 30, and a clipper 40. It is noted that the clipper 40 may be referred to herein as a clipper apparatus, clipper mechanism, and/or clipper assembly, but each term may be used interchangeably with the others. As shown, the apparatus 10 may optionally include an infeed conveyor 50. In the embodiment shown, the apparatus 10 can be described as a horizontal automatic clipping packaging apparatus as the product is primarily moved, processed, clipped and packaged in a horizontal plane. However, certain components, features or operations may be oriented and/or carried out in other planes or directions and the present invention is not limited thereto. For example, the product chute 30 may be tilted from horizontal, typically so that the discharge or egress end 30*d* is closer the ground than the product entry or ingress end 30*e* (as generally illustrated by FIG. 6B). The direction of travel of an exemplary product undergoing packaging is illustrated by the broken line arrows in this FIG. 1. Non-automated systems may have a generally straight path axially aligned with that of the chute axis as is known to those of skill in the art.

This positioning of the product in the flow path and/or alignment with the product chute cavity 30*c* can be carried out substantially automatically as will be discussed further below. However, a target product undergoing packaging can also be manually introduced or placed into the flow path and subsequently processed as in an automatic or manual in-feed operation.

Figure 2A:
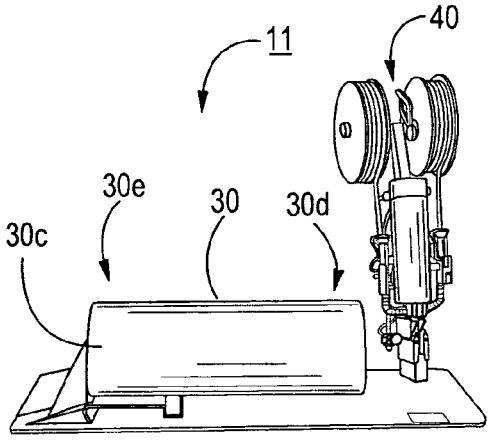
FIGS. 2A–2D are front views of a manual packaging system illustrating a sequence of operations that can employ the netting chutes of the present invention according to embodiments of the present invention.
Figure 2B:
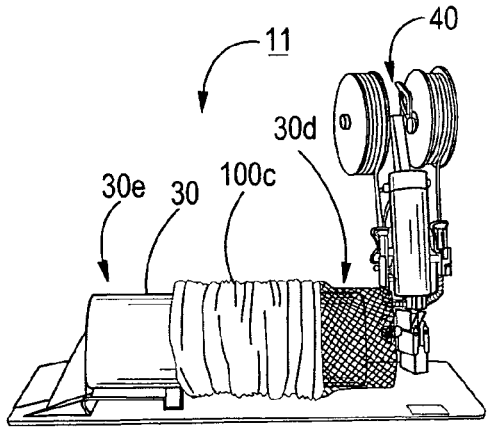
Figure 2C:
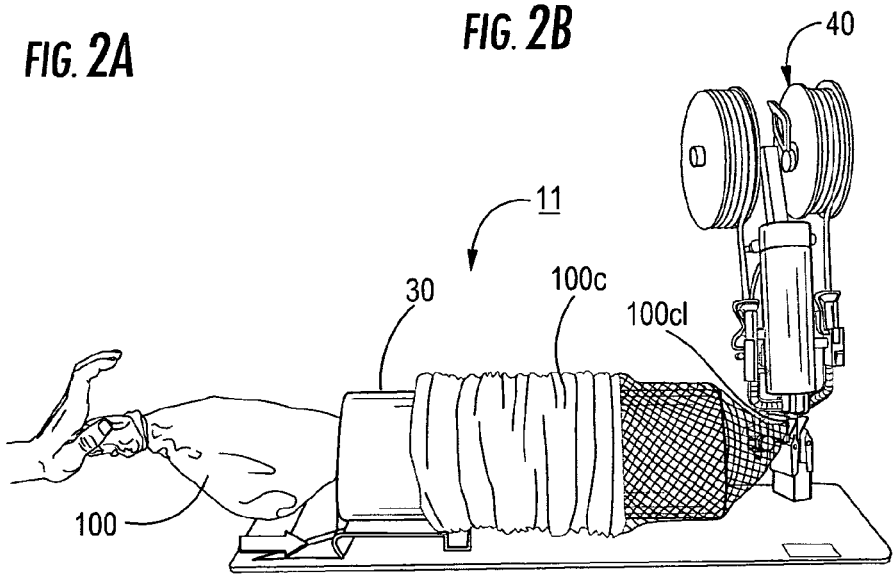

In operation, the product pusher assembly 20 linearly retracts and advances to push a product through the product chute 30 so that the product is positioned proximate the clipper 40 and then retracts to a resting state upstream of the product transfer zone 60. As described above, a sleeve of covering material 100*c* (FIG. 2B) can be positioned about the external surface of the product chute 30 and configured to be drawn downstream thereof so as to automatically encase the product as the product emerges from the discharge end 30*d* of the product chute 30. A supplemental sleeve material holder may also be used if desired instead of placing the sleeve of casing material on the product chute. The supplemental sleeve holder can be configured to surround a downstream portion of the product chute (not shown). The sleeve of covering material may be sized to stretch to substantially conform to the external wall or surface of the product chute 30 or may be more loosely held thereon. The cavity of the product chute 30*c* may be sized to snugly contact or squeeze opposing portions of the product (side to side and/or top to bottom) as the product is pushed therethrough or may be oversized with respect to the product so that the product loosely travels therethrough.

In some embodiments, the shape, size and/or type of product can determine a suitable netting diameter to provide a desired tightness of netting and, hence, influence the product chute design factor.

In operation, the sleeve of covering material may be clipped, welded, fused, knotted or otherwise closed at a leading edge portion thereof. When the product exits the product chute 30, it is held in the covering material as the covering material is drawn downstream. The covering material is typically loaded onto the product chute 30 and the leading edge portion closed before the product chute 30 is mounted to the apparatus 10. Additional description of a suitable automatic apparatus is described in co-pending, co-assigned U.S. Provisional Patent Ser. No. 60/508,609, filed Oct. 3, 2003, the contents of which were incorporated by reference above.

Figure 2D:
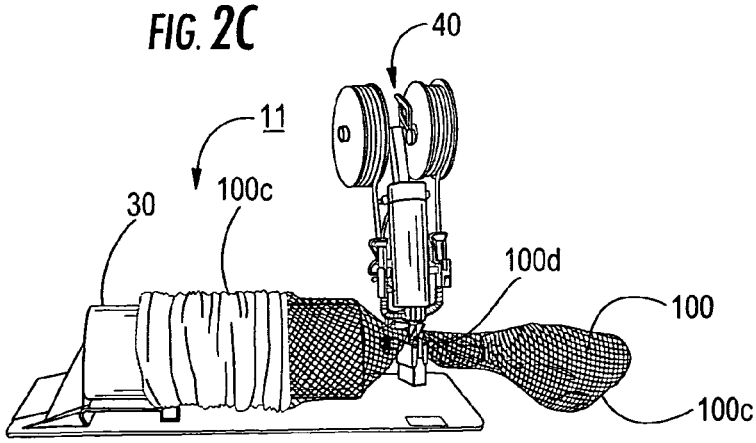

FIGS. 2A–2D illustrate a manual or semi-manual system 11 with a series of operations that can be used to package a target product 100 or products using a product chute 30 and a desired covering material 100*c*. FIG. 2D illustrates a clipped 100*cl* package of netting enclosing the product 100.

FIGS. 3–6B illustrate one embodiment of a product chute 30 that can be used with automatic and/or manual packaging systems. As shown, the product chute 30 includes an outer surface 30*s*, a cavity 30*c*, and a floor 30*f*. As shown, the floor 30*f* can be substantially planar and disposed at the lower portion of a curvilinear wall 30*w*. In certain embodiments, the chute 30 is configured so that the curvilinear wall 30*w* terminates or merges into the floor 30*f* to together define a non-circular cross-sectional shape of the cavity 30*c*.

Figure 4:
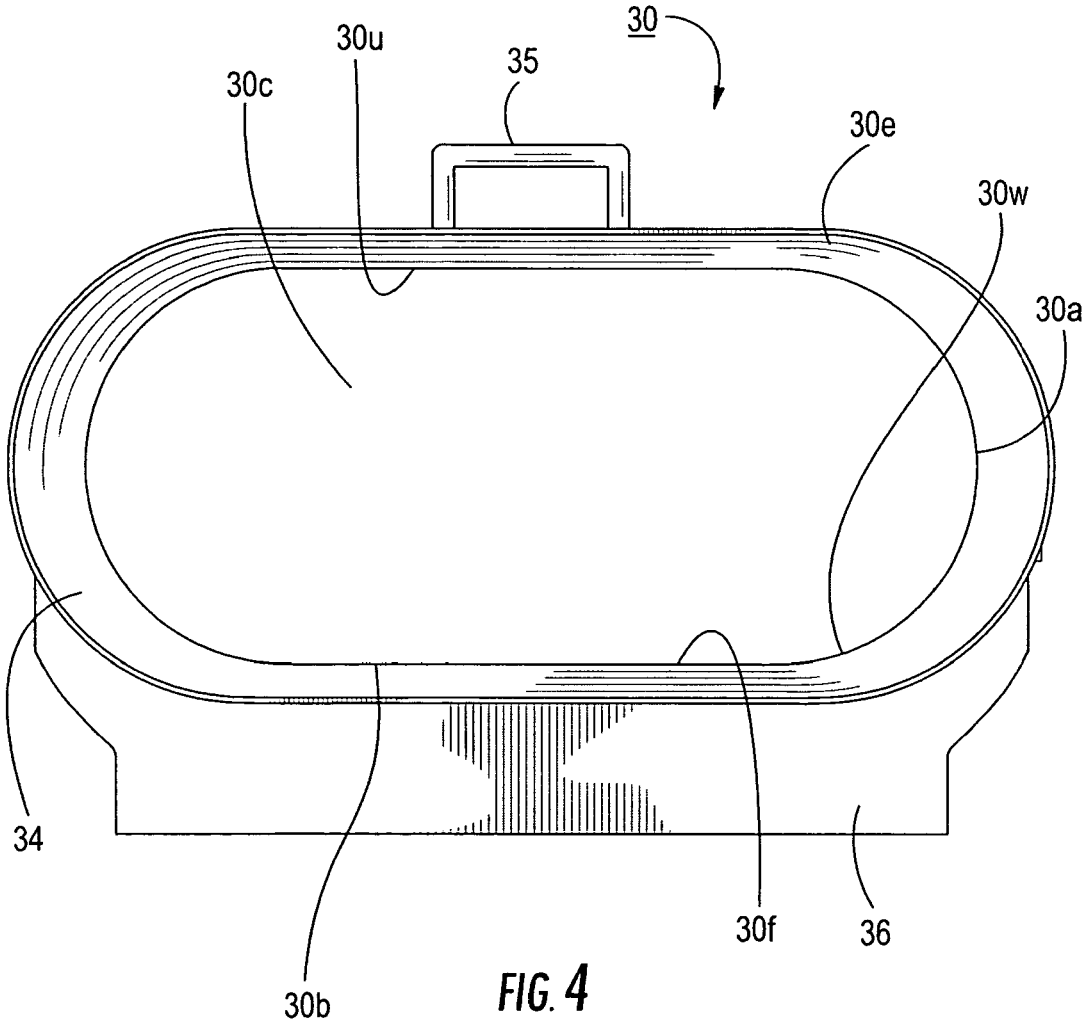
FIG. 4 is a front view of the product chute shown in FIG. 3.
Figure 5:
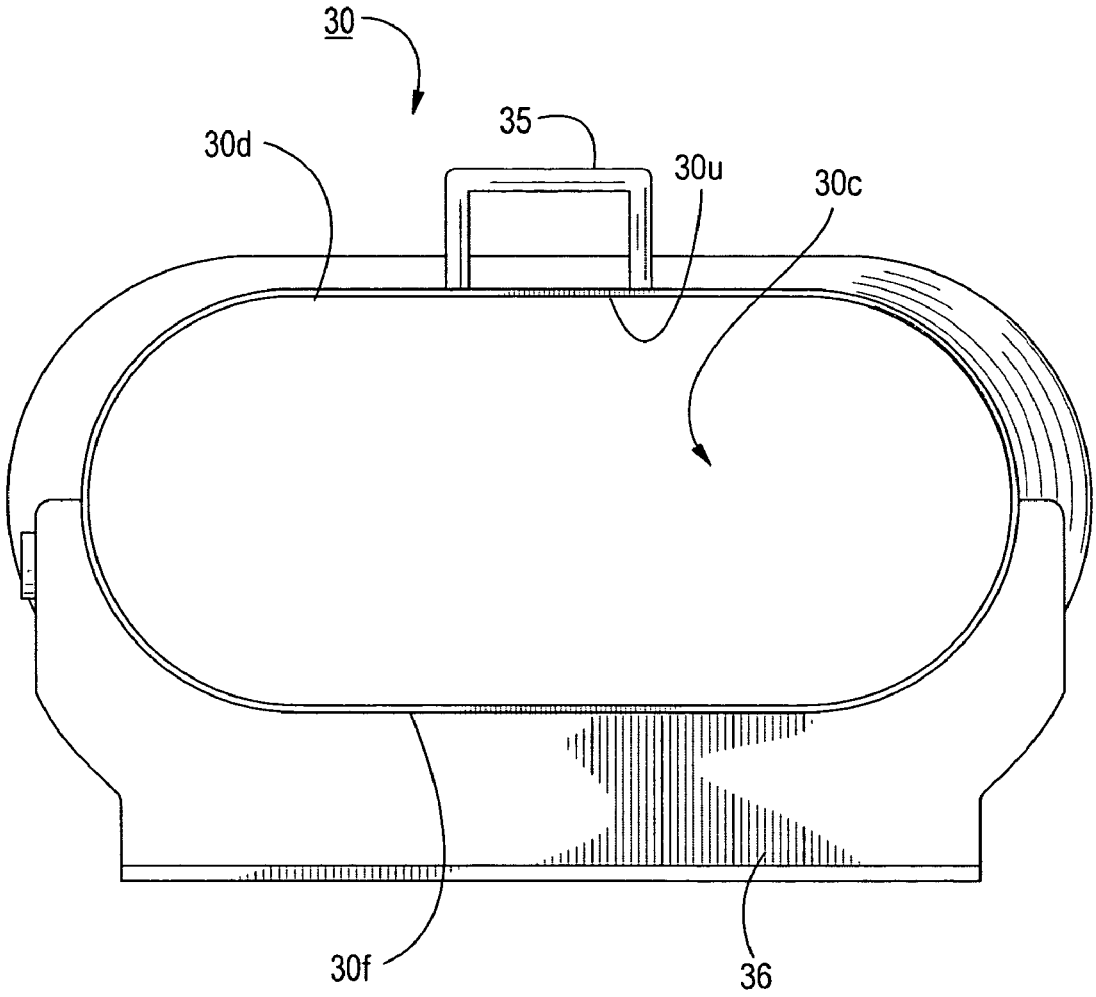
FIG. 5 is a rear view of the product chute shown in FIG. 3.

Thus, the product chute 30 has a cross-sectional profile that is non-circular. As shown in FIG. 4, the product chute 30 may be configured with a cavity 30*c* having a generally oval profile. In this embodiment, the cavity shape can be described as having a substantially planar bottom portion 30*b*, generally semi-circular side 30*a* portions, and a substantially planar upper portion 30*u*. Other cross-sectional profile configurations may also be used, including, but not limited to, circular, oval, triangular, rectangular, square and the like, and combinations thereof, examples of which will be described below.

Figure 3:
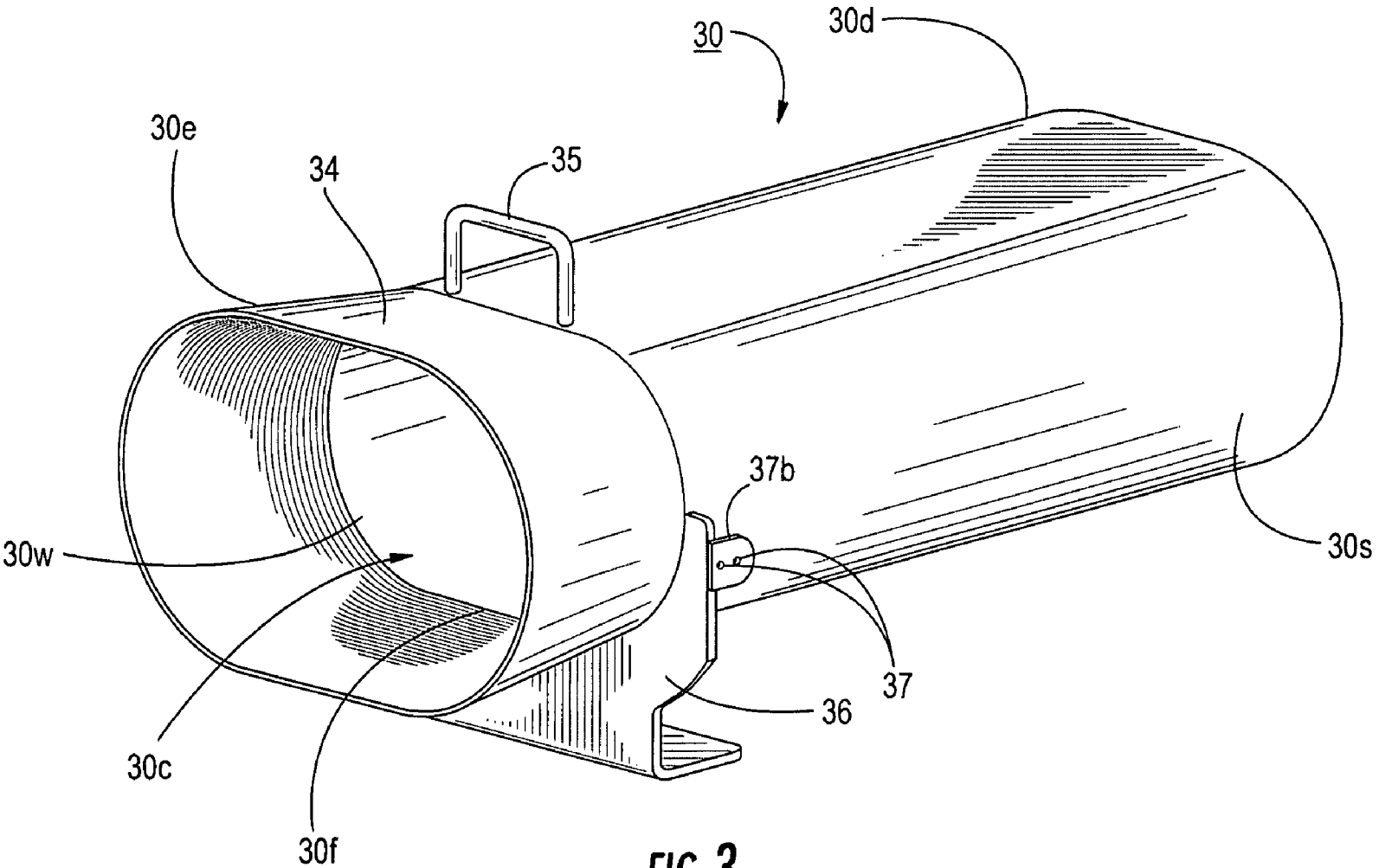
FIG. 3 is a side perspective view of a product chute according to embodiments of the present invention.

As is also shown in FIGS. 3 and 4, the product chute 30 may include an outwardly flaring forwardmost edge portion 34 that gradually tapers into the primary chute body. This flaring segment or portion 34 can be described as a funnel-like guide that may help direct objects into the primary body of the chute 30. Thus, the product chute 30 can include a larger front-end cavity area relative to the intermediate and/or discharging portion 30*d*, i.e., the chute cavity 30*c* narrows in the pushing/product travel direction. Thus, the product chute 30 can include a primary body and a larger upstream guide portion that narrows into the shape of the primary body.

The product chute 30 can include a handle 35 or other suitable gripping means thereon to facilitate operator handling. In addition, the product chute 30 may include a mounting bracket 36 that allows the chute 30 to be secured to a mounting frame during operation. In particular embodiments, the product chute 30 mounting bracket 36 is configured to releasably attach to a frame of an apparatus (such as that shown as reference number 10 in FIG. 1). As shown in FIGS. 3–6B, the mounting bracket 36 can be configured with an axially extending finger bracket 37*b* with at least one aperture 37 (shown as two) that can be used to hold a safety proximity or interlock sensor to inhibit operation of the clipping and/or product/pusher system when the product chute is not in proper position. An exemplary sensor is a two-part magnetic switch, one part of which can be positioned on chute bracket 37*b* as shown in FIG. 3 and the other part held on a mounting frame that holds the chute 30. When the two matable parts of the switch engage, the chute 30 is determined to be in proper position. Other types and/or additional sensors may also be used as suitable as is known to those of skill in the art.

In particular embodiments particularly suitable for automated systems 10 shown in FIG. 1, when a product 100 is detected in the transfer zone 60, the activation of the product pusher assembly 20 may be based on whether the product chute 30 is determined to be in proper position using data from the sensor held on bracket 37*b* (FIG. 3), and/or on a portion of the mounting frame holding the chute 30. In operation, a controller/processor (such as a Programmable Logic Controller) may be configured to monitor a signal from the proximity sensor and deactivate the product pusher assembly (release cylinder pressure) automatically whenever a product chute 30 position-error is noted at any time during the process. The signal can be automatically monitored through a Safety Circuit Computer Module. If the product chute 30 is missing or out of position, the apparatus 10 can be held in a low energy state that removes power to air supplies and controls to inhibit machine operation. To reinitiate the procedure, an operator may press a restart or reset button. In certain embodiments, the clipper 40 may be operated on override even when the chute 30 is absent. Once the product chute 30 is in location and the stop is reset, power air can be applied to the machine control valves and electric power can be applied to the control (PLC) outputs. After the PLC determines the positions of the moveable components, such as the product pusher assembly 20, the clipper 40, a product holding member (where used), and the like, an automatic reset can be performed and those components automatically moved to a respective home position as needed.

Figure 6A:
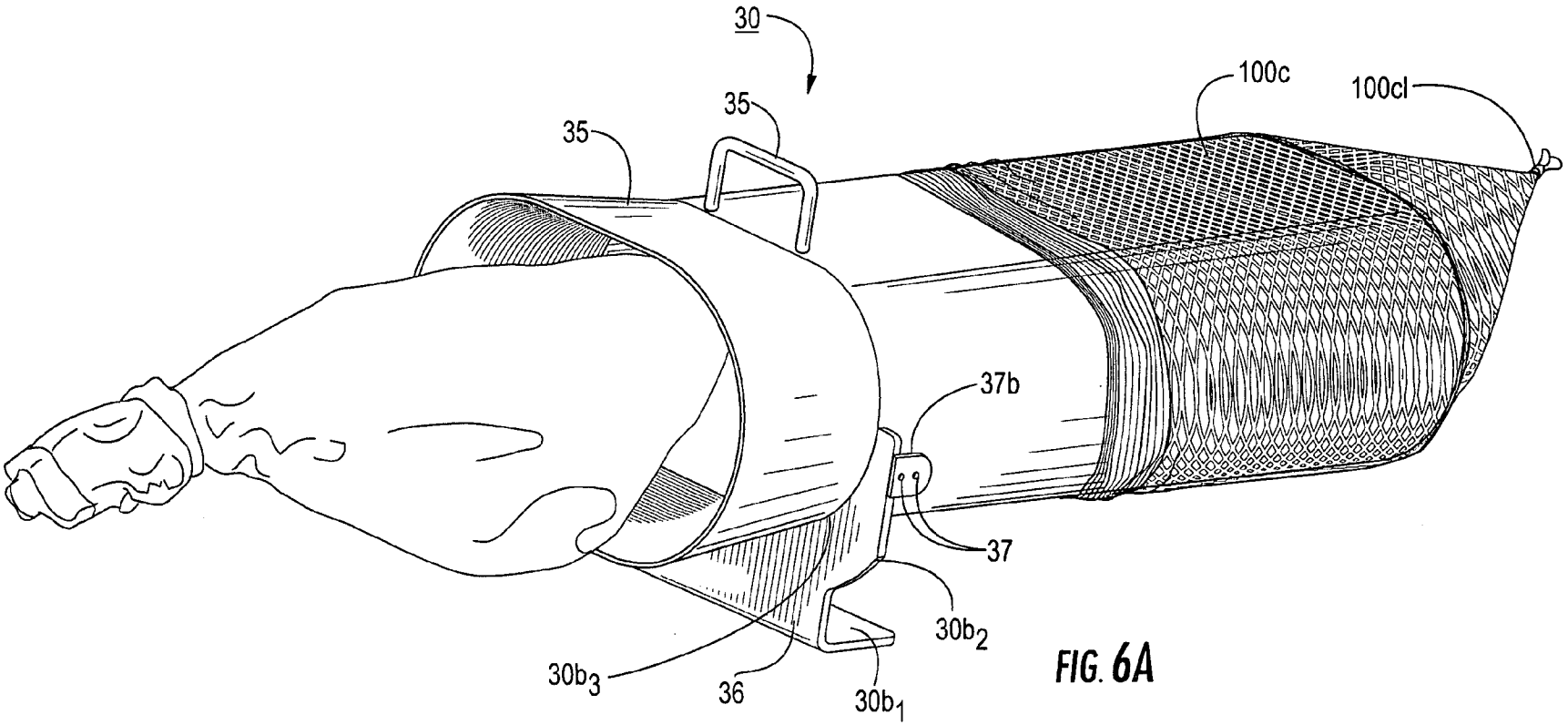
FIG. 6A is a side perspective view of the product chute shown in FIG. 3 illustrating an exemplary object therein in preparation for packaging with the product chute held substantially horizontally during operation according to embodiments of the present invention.
Figure 6B:
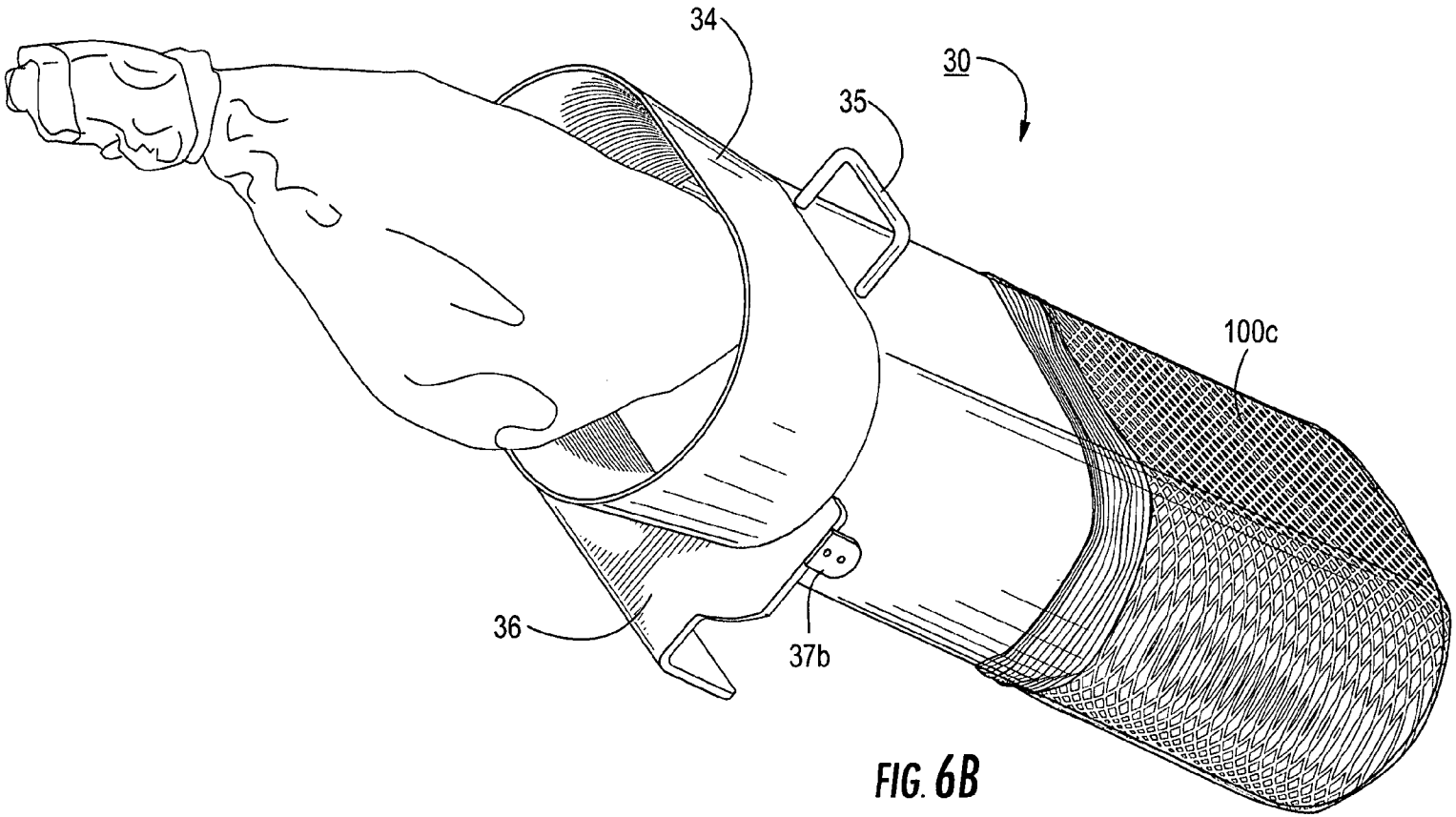
FIG. 6B is a side perspective view of the product chute shown in FIG. 3 with the product chute held tilted relative to horizontal during operation according to other embodiments of the present invention.

In operation, as shown in FIG. 6A, a supply of covering material 100*c* can be placed on or about the chute 30, arranged to surround the exterior surface of at least a portion of the product chute 30 and stretch in tension in the downstream direction to cover the product 100 (tenting in the axial direction) as the product exits the discharge end portion of the product chute 30*d*. In certain embodiments, the covering material 100*c* is configured and sized to stretch in at least the lateral direction and typically in both the lateral and axial directions as it is held on and dispensed from the product chute 30. The covering (typically netting) can be pulled to package successive objects until the sleeve is depleted.

FIG. 6A illustrates that the product chute 30 may be held substantially horizontal during operation. FIG. 6B illustrates that the product chute may be held tilted with respect to horizontal during operation. The tilt may be selected so that the chute extends angularly down at between about 30–60 degrees.

Although the product chute 30 is shown as having a continuous outer surface or wall, other configurations may also be used. For example, the chute wall or walls may include a slot or apertures and may not be a closed configuration, typically depending on the application. However, the chute 30 should be configured to provide sufficient structural support for the covering material (typically sized and configured to hold the covering stretched in both lateral and longitudinal directions) and to allow the product to enter the product material as it exits the product chute 30.

Figure 7:
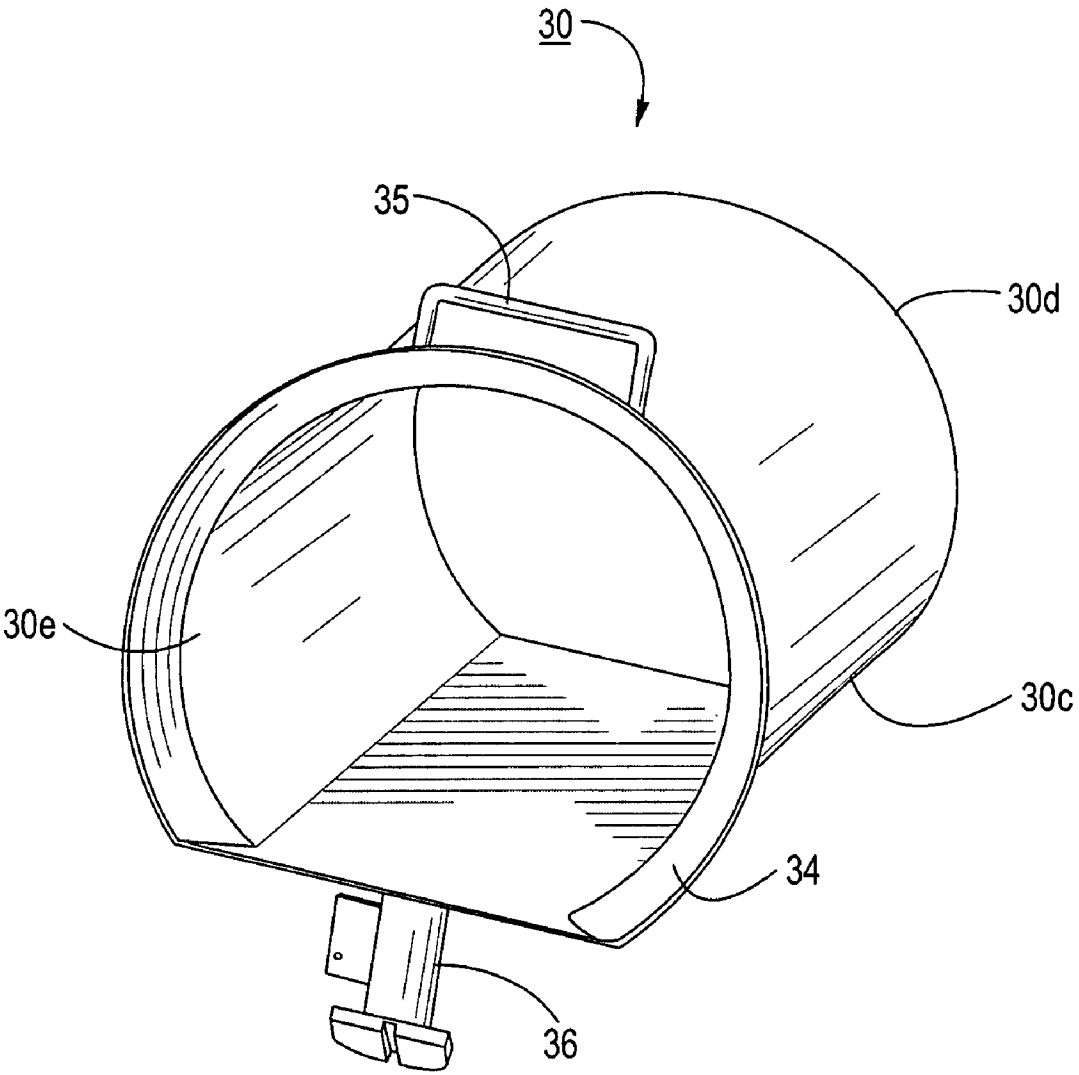
FIG. 7 is a front perspective view of a product chute according to other embodiments of the present invention.
Figure 8:
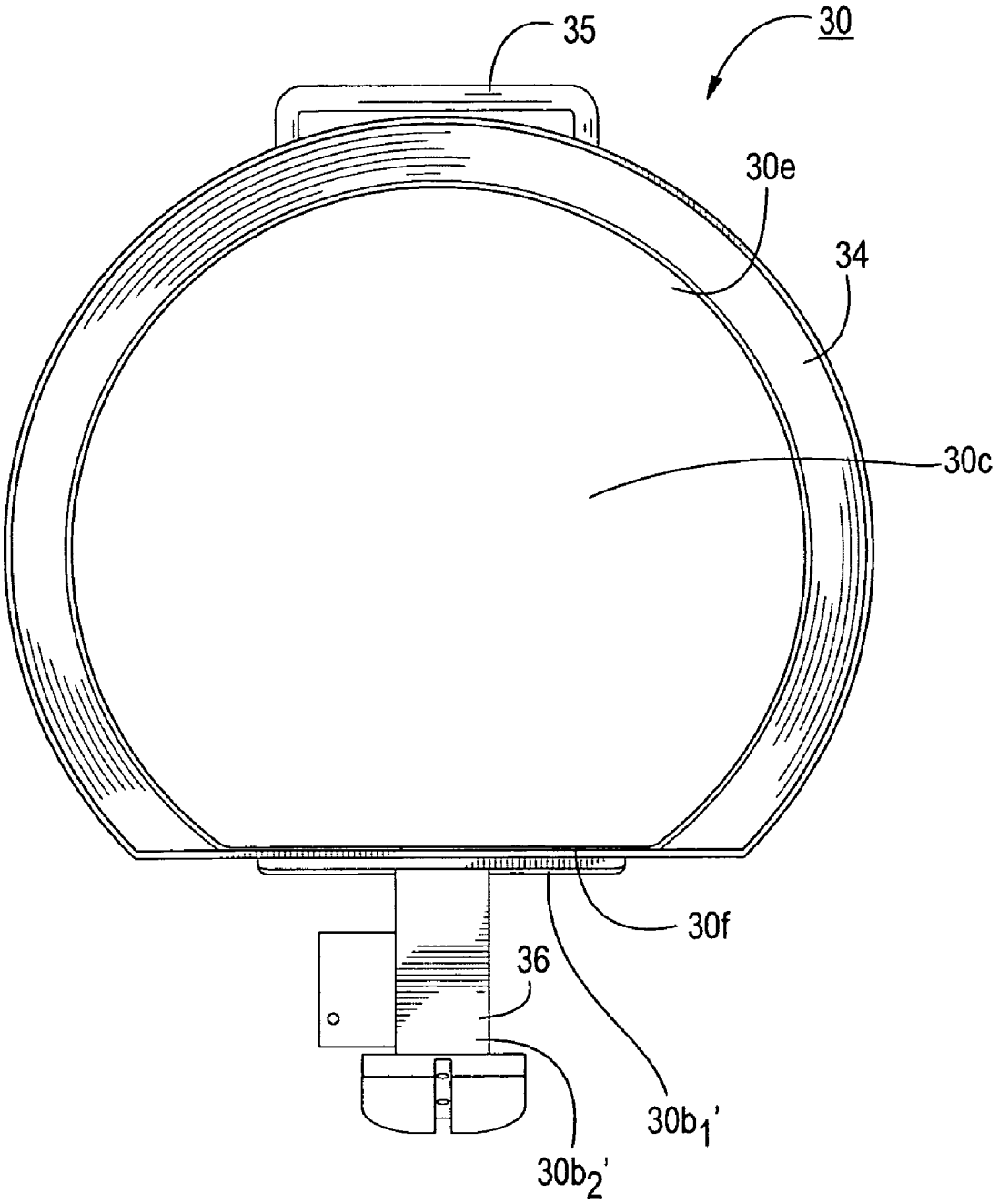
FIG. 8 is a front view of the product chute shown in FIG. 7.
Figure 9:
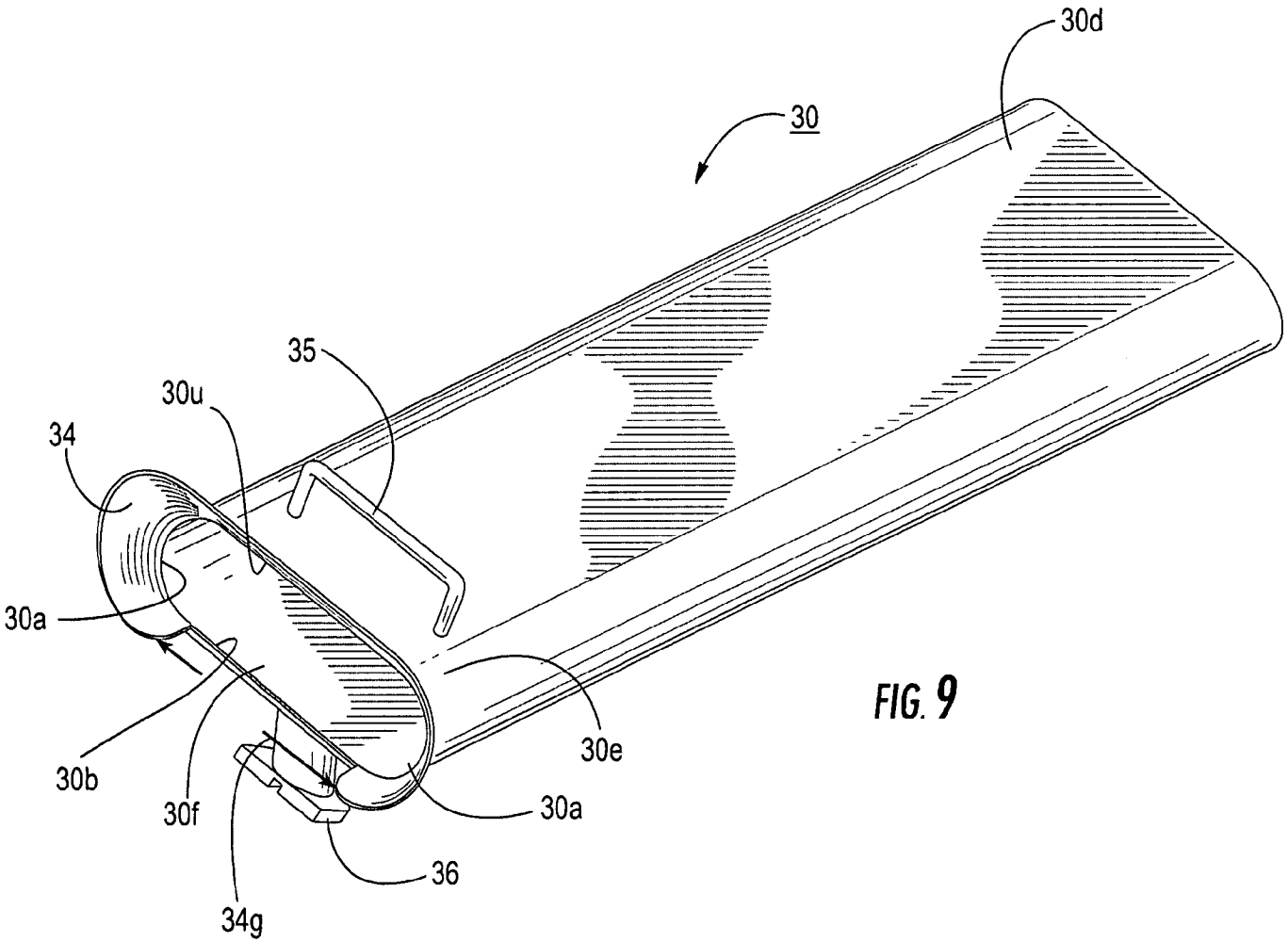
FIG. 9 is a side perspective view of another product chute according to yet other embodiments of the present invention.

FIGS. 7 and 8 illustrate another embodiment of a product chute 30. In this embodiment, the product chute 30 has a cavity that has a truncated circular profile. As shown in FIG. 8, the upper profile shape (when viewed from the end) is circular and is truncated by a generally planar floor 30*f*. As before, the forwardmost entry portion 30*e* can include a flared segment 34.

FIGS. 9–12 illustrate yet another embodiment of a product chute 30. As shown, the cavity 30*c* has a profile that is a generally elongate flattened oval. In this embodiment, the oval shape is more compressed than that of FIG. 3, with the cross-sectional shape of the cavity 30*c* having shorter circular sides 30*a* with relatively longer generally planar top and bottom segments 30*u*, 30*b*. However, similar to FIG. 3, the upper and lower portions 30*u*, 30*b*, respectively, of the product chute 30 can be generally planar, while the opposing side portions 30*a* are substantially semicircular (typically arcuate). Again, the forwardmost portion may include a flared entry segment 34. However, in this embodiment, the flared segment 34 has a discontinuous perimeter. That is, the flared segment 34 is attached to the primary body of the chute 30 and defines a gap space 34*g* proximate the floor 30*f* of the entry portion of the product chute 30.

Figure 10:
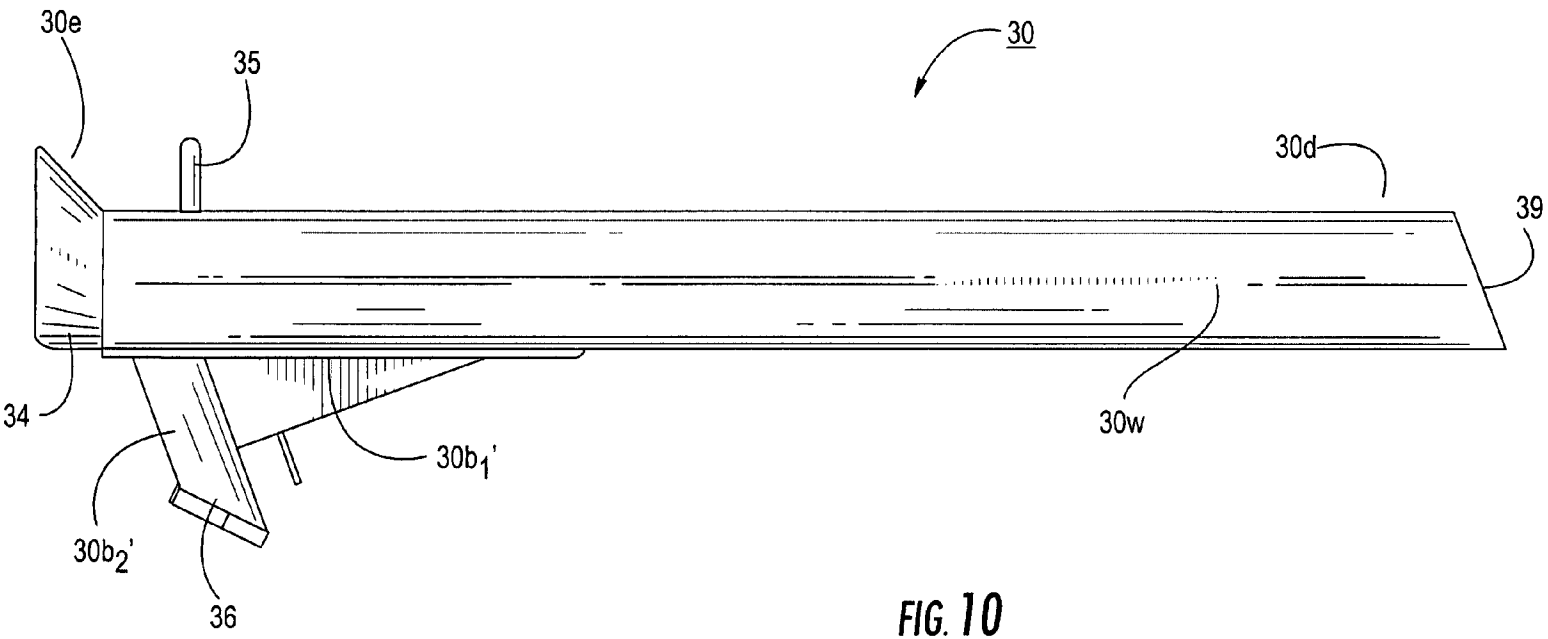
FIG. 10 is a side view of the product chute shown in FIG. 9.
Figure 11:
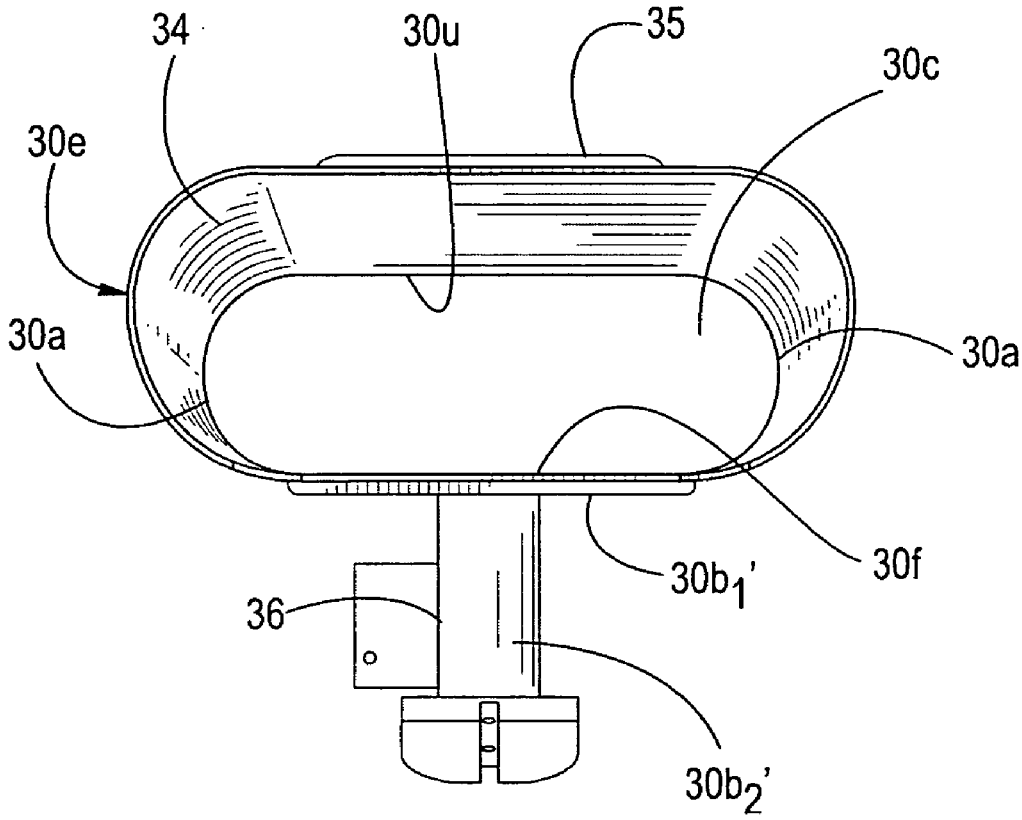
FIG. 11 is a front view of the product chute shown in FIG. 9.
Figure 12:
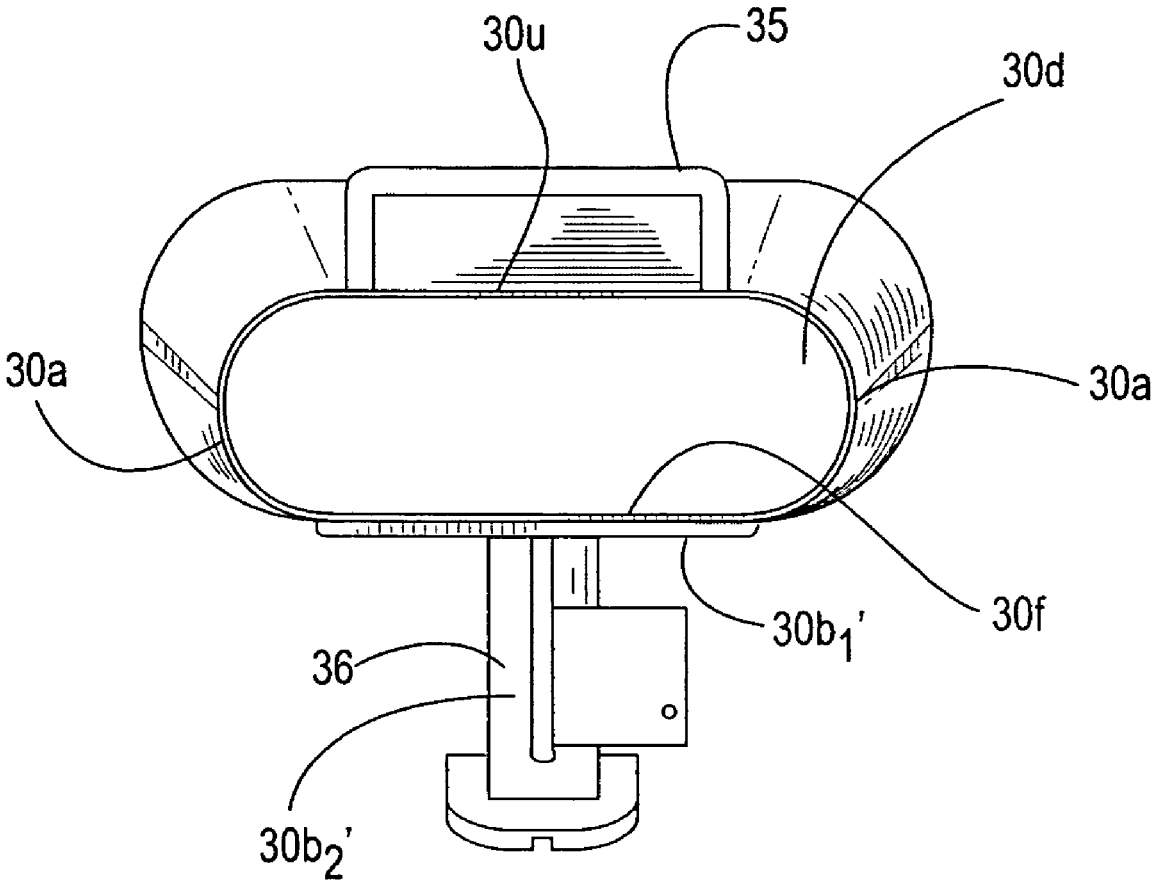
FIG. 12 is a rear end view of the product chute shown in FIG. 9.
Figure 13:
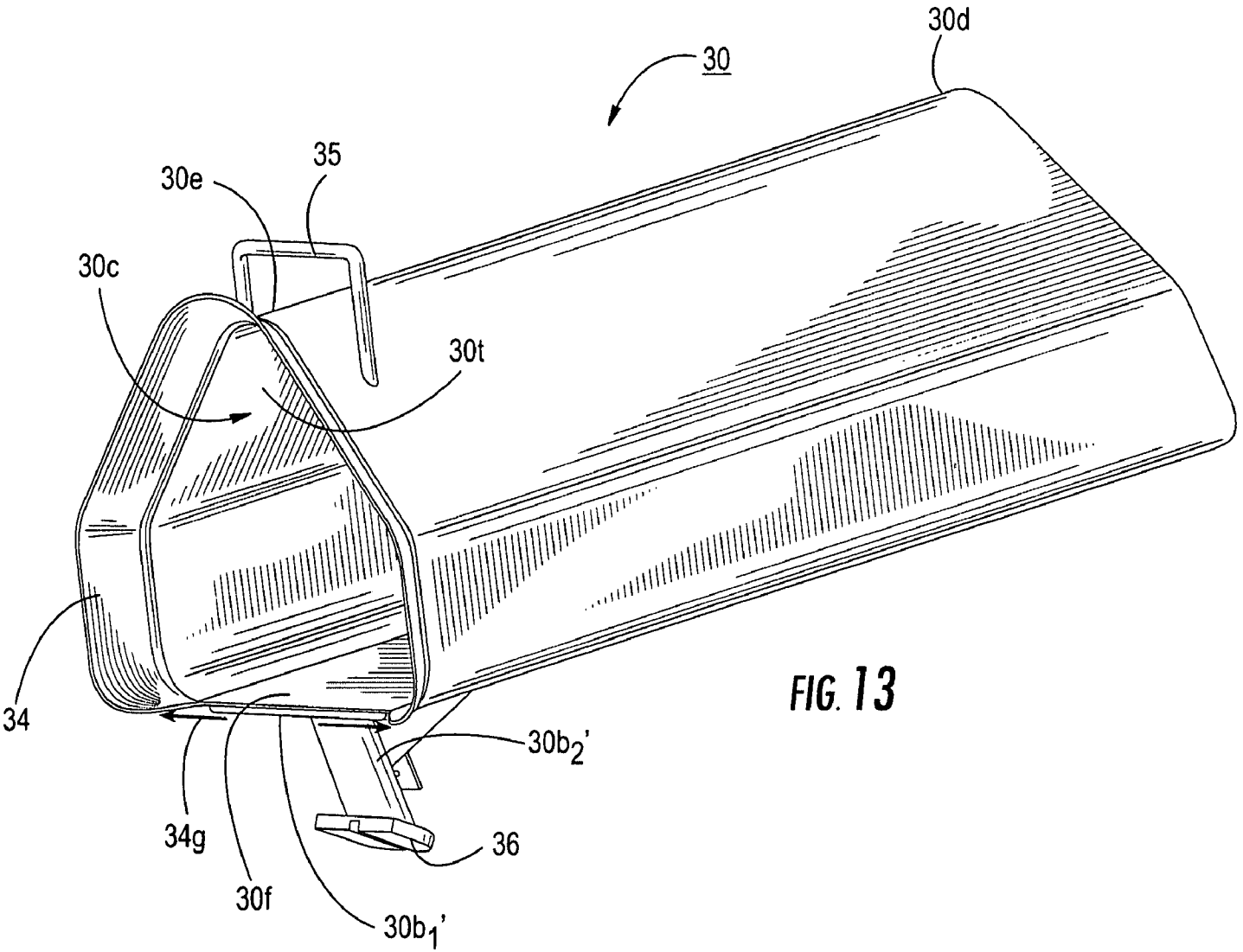
FIG. 13 is a side perspective view of another product chute according to additional embodiments of the present invention.
Figure 14:
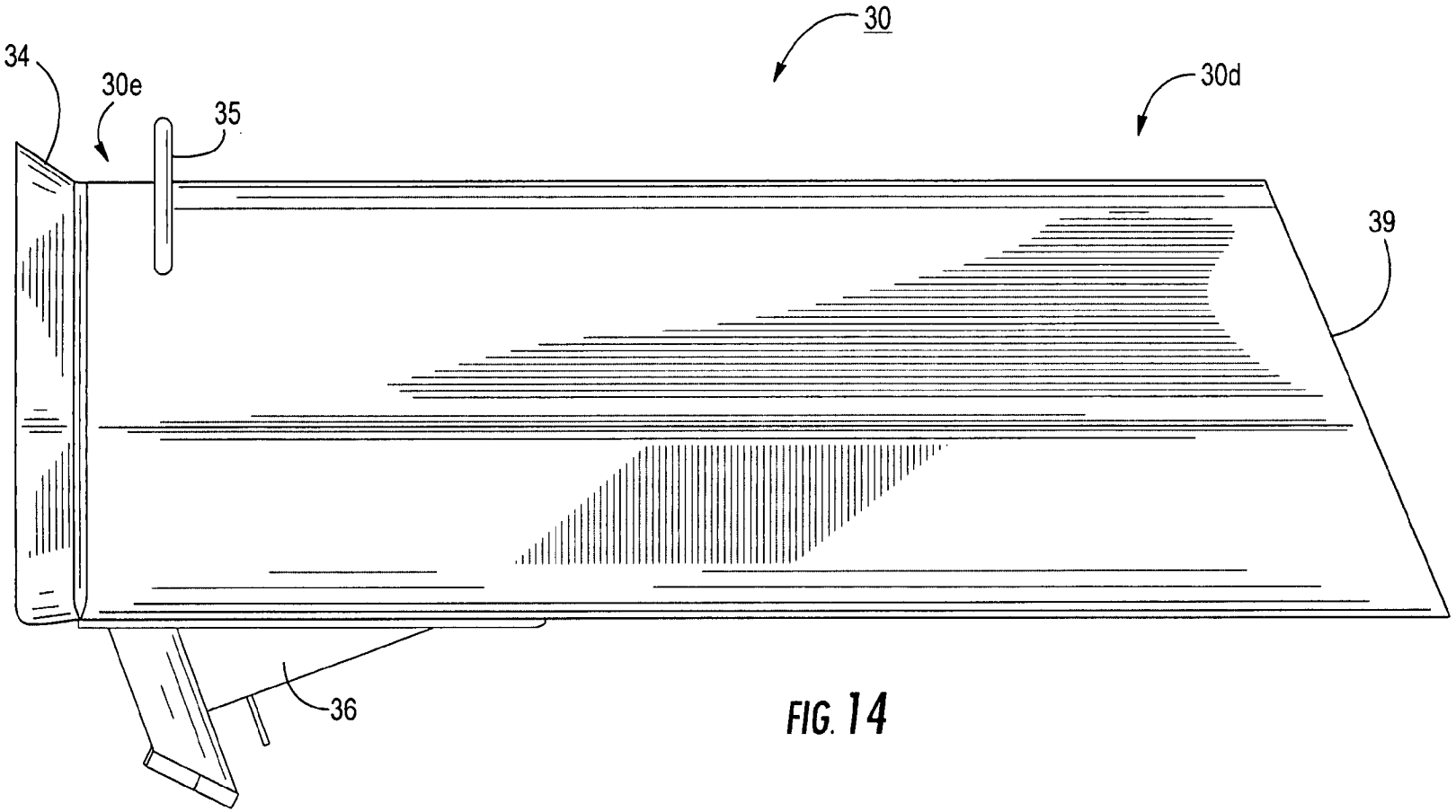
FIG. 14 is a side view of the product chute shown in FIG. 13.

FIG. 10 illustrates that the discharge end 30*d* of the chute 30 can be configured with an angular shape 39 when viewed from the side. This configuration can also apply to other chutes described herein (see, for example, FIG. 14). The discharge end 30*d* of the product chute may be configured so that a top axially extending length of the chute is shorter than a bottom axially extending length of the chute. As shown, the discharge end of the chute 30*d* is angled from top to bottom, typically at about 10–45 degrees.

Figure 15:
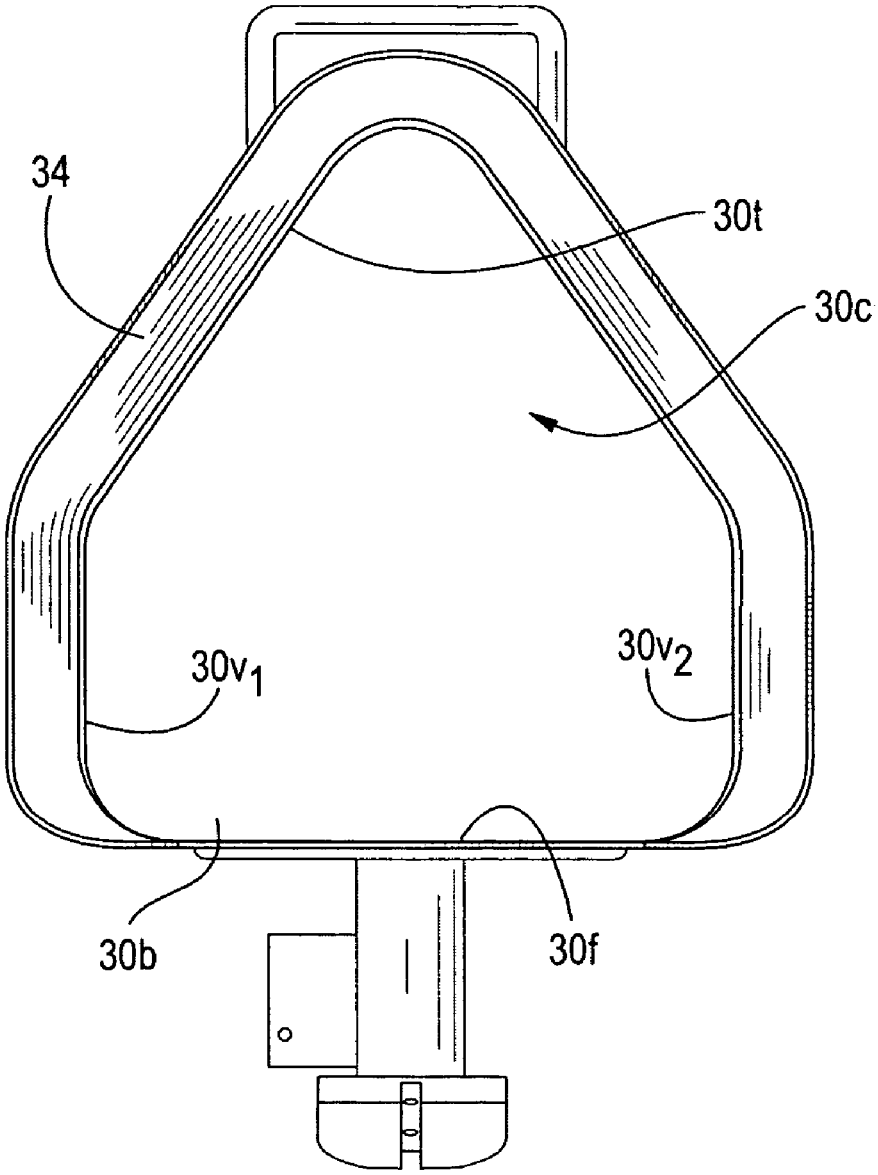
FIG. 15 is a front view of the product chute shown in FIG. 13.
Figure 16:
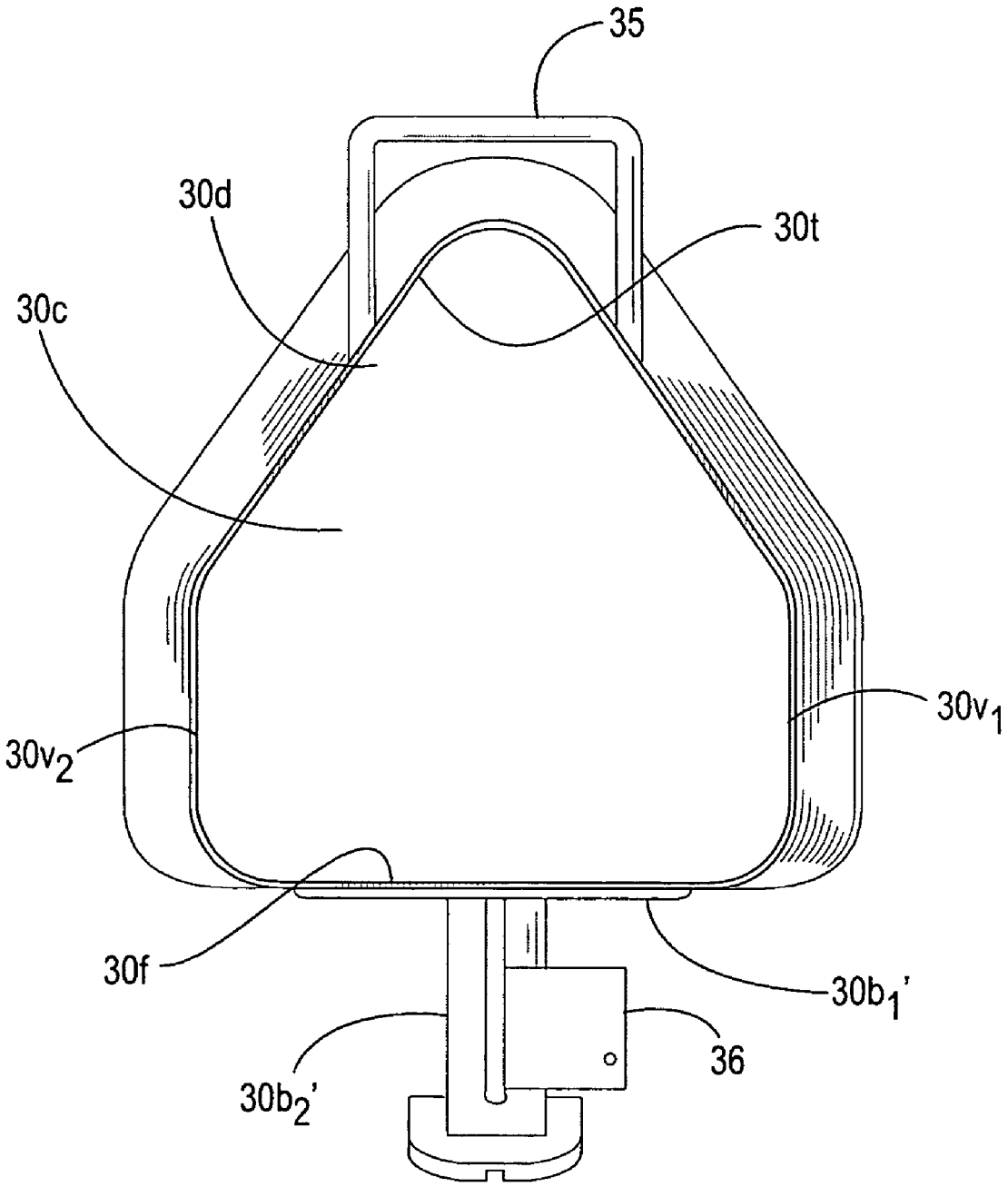
FIG. 16 is a rear end view of the product chute shown in FIG. 13.
Figure 17:
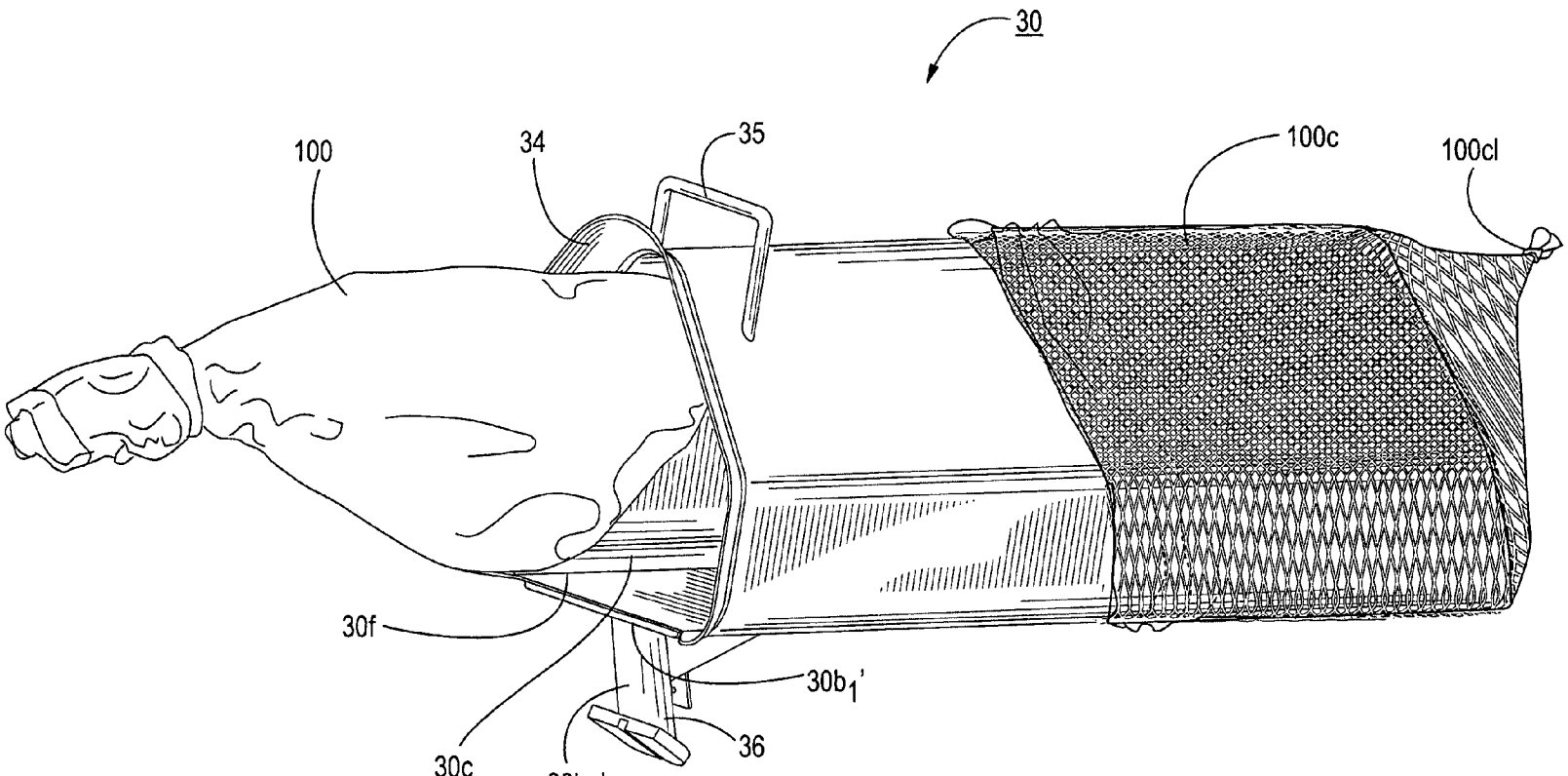
FIG. 17 is a side perspective view of the product chute shown in FIG. 13 with an exemplary object entering therein for packaging according to embodiments of the present invention.

FIGS. 13–17 illustrate yet another embodiment of a chute 30 according to the present invention. As shown, the chute 30 includes a generally triangular upper portion 30*t*. The generally pentagonal cross-sectional shape of the cavity 30*c* is shown in FIGS. 15 and 16. As shown in FIG. 15, when the chute is held horizontally, the upper generally triangulated portion 30*t* merges into opposing substantially downwardly extending (shown as vertical) side segments $\mathbf{30}v_1$, $\mathbf{30}v_2$, which merge into a bottom 30*b* substantially planar (shown as horizontal) floor segment 30*f*.

The chute 30 may be formed as a unitary member or a series of attached members (not shown). In certain embodiments, the product chute body may include a single continuous wall that defines the shape of the cavity 30*c*. In other embodiments, the product chute body can be formed with a plurality of walls. In some embodiments, the product chute 30 is fabricated from stainless steel. The interior surface or portions thereof may be coated with an anti-stick coating and/or lubricant. For example, the interior of the chute 30 may comprise TEFLON® polymer. In particular embodiments, a single sheet of metal can be formed to provide the desired curvilinear product chute body shape (at least the upper portion above the floor).

The chutes 30 can vary in length depending on the target object or objects and the netting or covering material used, and the like. In particular embodiments, the chutes can have lengths of between about one (1) foot–eight (8) feet long, and more typically between about 2–6 feet long.

Although shown with a single object in a netting package, other embodiments of the invention use the product chutes 30 to package groups of objects (not shown).

The product chute floor 30*f* may be a stationary floor as shown. However, it is also noted that the product chute 30 may include a moving floor. The chute 30 may be sized relative to the product 100 so that the product 100 extends across a major portion of the width of the cavity, and in certain embodiments, extends across at least about 75% of the width of the cavity. In certain embodiments, the product 100 and chute cavity 30*c* are sized so that the sides and/or top and bottom of the product 100 are pressed against the sidewalls of the chute cavity as the product is pushed therethrough.

As described above, the product chute 30 can be configured to mount on a mounting bracket 36 that fits into a frame on such as apparatus 10, 11 (FIGS. 1, 2). FIGS. 7–17 illustrate a mounting bracket 36 with a different configuration from that shown in FIGS. 3–6B. The bracket 36 shown in FIGS. 3–6B can include a planar platform $\mathbf{30}b_1$ (typically mounted substantially horizontal) that is connected to an upwardly extending segment $\mathbf{30}b_2$ (typically substantially vertical) with a recessed contour configured to receive the contour of the bottom of the product chute $\mathbf{30}b_3$.

FIGS. 7–17 illustrate a substantially planar platform 30$b_1$' that is attached to the planar bottom surface of a chute 30 and merges into a downwardly extending segment 30$b_2$'.

In any event, the mounting bracket 36 can be configured to relatively easily attach to and be removed from the frame of the apparatus (such as 10, 11, FIGS. 1, 2) so as to be releasably mountable thereto. The mounting bracket 36 can hold the product chute 30 in alignment with the clipper mechanism 40 downstream and, where used, the product pusher mechanism 20 upstream. In certain embodiments, the system 10, 11 can include a first product chute and a respective first mounting bracket 36 and a second product chute 30 releasably mountable to the apparatus frame 10, 11 at the same position (interchangeable chutes) using a respective second mounting bracket 36 that can be configured substantially the same as the first mounting bracket 36. In other embodiments, the product chute 30 can be lifted off of the mounting bracket 36 (leaving the mounting bracket in place) and another chute 30 placed thereon. The second product chute may be sized and configured the same as the first product chute 30 and loaded with a second supply of covering material. The covering material may be the same as that of the first product chute or different. Thus, the respective first and second mounting brackets 36 can be configured as quick disconnect components (merely loosening and/or releasing attachment hardware) to allow the first and second product chutes 30 to be interchanged on a system in under 5 minutes, and more typically in under about 2 minutes, to allow an operator to employ at least one of a different size product chute, a different configuration product chute, different packaging material dispensed by the product chute.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A system for enclosing at least one semi-solid or solid product in a covering material, comprising:

a plurality of interchangeable elongate product chutes, each chute having a floor and an outer wall with opposing receiving and discharge end portions and an interior cavity extending therethrough, wherein the plurality of product chutes have a different configuration than others, and wherein at least some of the cavities have a non-circular cross-sectional shape with a flared entry segment with a first cross-sectional area that tapers into an adjacent downstream portion to have a smaller second cross-sectional area thereat, and wherein the elongate product chutes comprise a handle extending above a generally medial location of an upper portion of the outer wall;

a mounting frame configured to releaseably hold one of the interchangeable chutes such that each chute has substantially the same axially extending centerline when mounted on the mounting frame, wherein the product chutes have a respective mounting bracket that releasably attaches to the mounting frame, and wherein at least one of the mounting brackets for the interchangeable product chutes has a different configuration from the others;

a clipper mechanism disposed downstream of the mounted product chute, the clipper mechanism configured to apply at least one clip to a covering material that resides over and encloses a product discharged from the product chute; and a sleeve of netting held over the outer wall of the mounted product chute downstream of the handle.

2. A system according to claim 1, wherein the cavity has a generally pentagonal cross-sectional shape.

3. A system according to claim 1, wherein the cavity cross-sectional shape comprises an upper triangular portion.

4. A system according to claim 1, wherein the cavity cross-sectional shape is generally oval.

5. A system according to claim 4, wherein the outer wall defines the oval shape and comprises opposing generally semicircular sides that merge into opposing generally planar upper and lower portions.

6. A system according to claim 1, wherein the product chute outer wall has a cross-sectional shape with a generally curvilinear upper portion that terminates into the lower generally planar floor.

7. A system according to claim 1, wherein the product chute outer wall has cross-sectional shape with an upper circular shape that defines a major portion of the shape and is truncated by the generally planar floor.

8. A system according to claim 1, wherein a discharge end of the product chute has an angular cross section when viewed from the side so that a length of an upper portion of the product chute is less than a length of a lower portion of the product chute.

9. A system according to claim 1, wherein the sleeve of netting material is configured to be held in tension and extends a distance beyond a discharge end of the chute during operative use.

10. A system according to claim 1, wherein at least one of the mounting brackets has a mounting bracket having a lowermost generally planar substantially horizontal mounting platform and an opposing upper portion that is attached to a bottom of the respective product chute, and wherein at least a different one of the mounting brackets for the interchangeable product chutes has a different configuration.

11. A system according to claim 1, wherein at least one of product chute mounting brackets has a generally concave transversely extending contoured recess configured to receive a lower bottom portion of the product chute therein, and wherein at least another one of the product chute mounting brackets has an upstanding segment with a planar substantially horizontal upper portion that holds the lower portion of the product chute.

12. A system according to claim 11, wherein the contoured recess mounting bracket configuration has an angled bracket with the contoured recess merging into a first downwardly extending generally planar vertical segment that, in turn merges into an axially extending generally planar horizontal segment.

13. A system according to claim 1, wherein the mounting bracket comprises a sensor that cooperates with a component on a mounting frame to inhibit operation when the chute is not in proper operative position.

14. A system according to claim 1, wherein the flared entry segment of at least some of the product chutes define a gap space proximate to and upstream of the floor of a primary body portion of the mounted product chute.

15. A system according to claim 1, wherein at least one of the product chute interior cavities has a cross-sectional profile that is sized and configured to snugly receive and/or compress a product as the product moves along the length thereof.

16. A system according to claim 1, wherein the mounted product chute is held substantially horizontal during operation.

17. A system according to claim 1, wherein the mounted product chute is held tilted relative to horizontal during operation.

18. A method of packaging an object or objects in netting, comprising:

pushing at least one object through a first product chute releasably mounted to a mounting frame, the first product chute having a floor and a non-circular cross-sectional shape and an axially extending centerline, wherein the chute comprises a primary body and a flared entry portion with a first cross-sectional area that tapers into an adjacent downstream portion proximate the primary body to have a smaller second cross-sectional area thereat;

pulling netting material downstream of the product chute off of an exterior surface of the product chute to automatically enclose the object in the netting material as the object exits the product chute; then applying at least one clip to the netting material to secure the object in the netting material using an automated or semi-automated clipper; and replacing the first product chute and an attached mounting bracket with a second product chute having, a different cross sectional shape and/or size and a differently configured second mounting bracket, the second mounting bracket being releaseably mounted to the same mounting frame as the first product chute mounting bracket such that the second product chute is placed in cooperating alignment with the clipper about an axially extending centerline that substantially coincides with that of the first product chute.

19. A method according to claim 18, wherein the netting material comprises a sleeve of elastic netting material, the method further comprising automatically electronically inhibiting operation when the first or second chute is not in proper operative position.

20. A method according to claim 18, wherein the netting material comprises netting material that is elastically isotropic to thereby be stretchable in an axial direction and in a direction that is substantially orthogonal thereto.

21. A method according to claim 18, wherein the first chute has a generally planar floor.

22. A method according to claim 21, wherein the first chute has a substantially planar floor.

23. A method according to claim 18, wherein the first chute cavity has a generally pentagonal cross-sectional shape.

24. A method according to claim 18, wherein the first chute cavity cross-sectional shape comprises an upper substantially triangular portion.

25. A method according to claim 18, wherein the first chute cavity cross-sectional shape is generally oval.

26. A method according to claim 25, wherein the first product chute is configured with at least one wall that defines the oval and comprises opposing semicircular sides that merge into opposing generally planar upper and lower portions.

27. A method according to claim 18, wherein the first product chute has an outer wall wit a cross-sectional shape having a generally curvilinear upper portion that terminates into a generally planar lower floor portion.

28. A method according to claim 18, wherein the first product chute has an upper circular cross-sectional shape that is truncated by a generally planar floor.

29. A method according to claim 18, wherein a discharge end of the first product chute has an angular cross section when viewed from the side so that a length of an upper portion of the product chute is less than a length of a lower portion of the product chute.

30. A method according to claim 18, further comprising placing a sleeve of netting material over the first and second product chute before mounting the selected chute to the mounting frame and stretching the sleeve so that it is in tension in at least the axial direction and extends a distance beyond a discharge end of the respective chute prior to the pulling and/or applying step.

31. A method according to claim 30, wherein the first product chute mounting bracket has a transversely extending generally concave recess having a contour that generally matches that of a bottom portion of the product chute.

32. A method according to claim 18, wherein the object is a meat product.

33. A method according to claim 32, wherein the meat product is a ham.

34. A method according to claim 32, wherein the meat product comprises turkey held in a mold.

35. A system for enclosing at least one semi-solid or solid product in a covering material, comprising:

a plurality of interchangeable elongate product chutes, each respective chute having a different size and/or shape, an outer wall, opposing receiving and discharge end portions and an interior generally straight cavity extending therethrough, with the chute cavities having a non-circular cross-sectional shape;

a mounting bracket attached to each respective product chute, wherein each respective product chute mounting bracket is individually releasably mountable to a frame that holds the mounted product chute in alignment with a clipper mechanism during operation such that each mounted product chute has a substantially common axially extending centerline, and wherein some of the chutes have a first mounting bracket configuration and the others have a second mounting bracket configuration that is different from the first mounting bracket configuration; and a clipper mechanism disposed downstream of the product chute, the clipper mechanism configured to apply at least one clip to a covering material that resides over and encloses a product discharged from the mounted product chute.

36. A system according to claim 35, wherein the first mounting bracket configuration has a transversely extending contoured generally concave recess configured to releasably receive a lower portion of the respective product chute therein.

37. A system according to claim 36, wherein the first mounting bracket configuration has a generally planar upwardly extending medial portion that merges into the contoured recess at a top portion thereof and merges into a planar substantially horizontal mounting platform at a lower portion thereof.

38. A system according to claim 35, wherein the respective mounting brackets comprise an electronic component that cooperates with an electronic component on the mounting frame that, in position on the mounting frame, is configured to inhibit operation when the mounted chute is not in proper operative position.

39. A method of packaging products in netting using a packaging system, comprising:

releasably mounting a selected one of a plurality of interchangeable product chutes having a respective underlying mounting bracket to a common system mounting frame, the plurality of interchangeable product chutes having different configurations from the others;

aligning the selected product chute with a clipper mechanism located downstream of the mounted product chute such that, when mounted in operative position, each product chute has a substantially common axial centerline in cooperating alignment with the clipper mechanism; and releasably mounting a second selected one of the plurality of interchangeable chutes, the second product chute mounting bracket having a different configuration from that of the mounting bracket of the first mounted product chute.

40. A method according to claim 39, wherein one of the product chutes has a substantially pentagonal cross sectional configuration, another of the product chutes has a substantially oval cross-sectional configuration, and another of the product chutes has a substantially planar floor with a curvilinear upper portion.

41. A packaging system, comprising:

a plurality of interchangeable elongate product chutes, each chute having a respective mounting bracket attached to a lower portion thereof, each chute having an outer wall, opposing receiving and discharge end portions, and an interior generally straight cavity extending therethrough, with at least one of the chute cavities has a non-circular cross-sectional shape, wherein the chutes have a different size and/or shape from that of the others, and wherein some of the chutes have a first mounting bracket configuration and others have a second different mounting bracket configuration;

a frame configured to serially releasably mount the interchangeable product chutes, wherein each of the plurality of interchangeable chutes have substantially the same axially extending centerline when mounted to the frame; and a clipper mechanism disposed downstream of the product chute, the clipper mechanism configured to apply at least one clip to a covering material that resides over and encloses a product discharged from the mounted product chute.

42. A packaging system according to claim 41, wherein the first mounting bracket configuration comprises a generally planar upwardly extending medial portion that merges into the contoured recess at a top portion thereof and merges into a planar substantially horizontal mounting platform at a lower portion thereof, and wherein the second mounting bracket configuration comprises an upwardly extending leg that merges into a generally planar upper portion.

43. A packaging system according to claim 42, wherein the mounting brackets each comprise an electronic member that cooperates with a component on the frame to automatically electronically inhibit operation of the clipper when a mounted chute is not in proper operative position.

44. A packaging system according to claim 42, wherein the first configuration has an uppermost laterally extending portion with a generally concave recess that receives a lower portion of the respective chute therein, and wherein the second configuration has a generally planar uppermost portion that merges into a downwardly extending member, the downwardly extending member having a width that is less than a width of the planar portion.

45. A system according to claim 43, wherein the mounting bracket sensors comprise one component of a two-part magnetic switch, and wherein the other component of the two-pan magnetic switch resides on the frame.

* * * * *

UNITED STATES PATENT AND TRADEMARK OFFICE

CERTIFICATE OF CORRECTION

PATENT NO. : 7,021,026 B2
APPLICATION NO. : 10/738547
DATED : April 4, 2006
INVENTOR(S) : Griggs et al.

It is certified that error appears in the above-identified patent and that said Letters Patent is hereby corrected as shown below:

Column 12,
Line 7 should read -- product chute has an outer wall with a cross-sectional shape --

Signed and Sealed this

Nineteenth Day of September, 2006

JON W. DUDAS
*Director of the United States Patent and Trademark Office*